US007285697B2

(12) United States Patent
Keusenkothen

(10) Patent No.: US 7,285,697 B2
(45) Date of Patent: Oct. 23, 2007

(54) REDUCTION OF TOTAL SULFUR IN CRUDE AND CONDENSATE CRACKING

(75) Inventor: Paul F. Keusenkothen, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 692 days.

(21) Appl. No.: 10/893,716

(22) Filed: Jul. 16, 2004

(65) Prior Publication Data

US 2006/0014994 A1 Jan. 19, 2006

(51) Int. Cl.
*C10G 9/36* (2006.01)

(52) U.S. Cl. ..... 585/652; 585/648; 585/650; 208/105; 208/125; 208/130; 208/132

(58) Field of Classification Search ..... 585/652, 585/648, 650; 208/105, 125, 130
See application file for complete search history.

(56) References Cited

U.S. PATENT DOCUMENTS

| | | | | |
|---|---|---|---|---|
| 1,936,699 | A | 11/1933 | Weaver | 196/116 |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | 23/284 |
| 3,341,429 | A | 9/1967 | Fondrk | 203/95 |
| 3,412,211 | A | 11/1968 | Becraft et al. | 208/93 |
| 3,487,006 | A | 12/1969 | Newman et al. | 208/93 |
| 3,492,795 | A | 2/1970 | Guerrieri | 55/463 |
| 3,505,210 | A | 4/1970 | Wallace et al. | 208/228 |
| 3,617,493 | A | 11/1971 | Wirth et al. | 208/80 |
| 3,677,234 | A | 7/1972 | Dutkiewicz | 122/240 |
| 3,718,709 | A | 2/1973 | Simonetta | 260/683 R |
| 3,900,300 | A | 8/1975 | Lehman | 55/184 |
| 4,199,409 | A | 4/1980 | Skraba | 203/39 |
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | 208/130 |
| 4,400,182 | A | 8/1983 | Davies et al. | 48/214 |
| 4,426,278 | A | 1/1984 | Kosters | 208/130 |
| 4,543,177 | A | 9/1985 | Murthy et al. | 208/130 |

(Continued)

FOREIGN PATENT DOCUMENTS

| | | |
|---|---|---|
| DE | 1093351 | 11/1960 |

(Continued)

OTHER PUBLICATIONS

"Speciality Furnace Design: Steam Reformers and Steam Crackers", presented by T.A. Wells of the M.W. Kellogg Company, 1988 AIChE Spring National Meeting.

(Continued)

*Primary Examiner*—Tam N. Nguyen

(57) ABSTRACT

A process for cracking hydrocarbon feedstock comprising at least one sulfur-containing compound comprising: heating the feedstock and a peroxide-containing compound, mixing the heated feedstock and peroxide-containing compound with a fluid and/or a primary dilution steam stream to form a mixture, flashing the mixture to form a vapor phase and a liquid phase which collect as bottoms and removing the liquid phase, separating and cracking the vapor phase, and cooling the product effluent, wherein the oxidized sulfur-containing species are removed as bottoms

19 Claims, 1 Drawing Sheet

U.S. PATENT DOCUMENTS

| | | | | |
|---|---|---|---|---|
| 4,615,795 | A | 10/1986 | Woebcke et al. | 208/72 |
| 4,714,109 | A | 12/1987 | Tsao | 165/104.18 |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | 208/355 |
| 5,096,567 | A | 3/1992 | Paspek, Jr. et al. | 208/106 |
| 5,120,892 | A | 6/1992 | Skraba | 585/652 |
| 5,190,634 | A | 3/1993 | Fernandez-Baujin et al. | 208/107 |
| 5,468,367 | A | 11/1995 | Dickakian et al. | 208/48 |
| 5,580,443 | A | 12/1996 | Yoshida et al. | 208/130 |
| 5,817,226 | A | 10/1998 | Lenglet | 208/130 |
| 5,910,440 | A | 6/1999 | Grossman et al. | 435/282 |
| 6,093,310 | A | 7/2000 | Swan | 208/113 |
| 6,123,830 | A | 9/2000 | Gupta et al. | 208/76 |
| 6,179,997 | B1 | 1/2001 | Vedder, Jr. et al. | 208/113 |
| 6,190,533 | B1 | 2/2001 | Bradow et al. | 208/57 |
| 6,210,561 | B1 | 4/2001 | Bradow et al. | |
| 6,303,842 | B1 | 10/2001 | Bridges et al. | 585/648 |
| 6,376,732 | B1 | 4/2002 | Ngan et al. | 585/800 |
| 6,632,351 | B1 | 10/2003 | Ngan et al. | 208/132 |
| 6,743,961 | B2 | 6/2004 | Powers | 585/648 |
| 2001/0016673 | A1 | 8/2001 | Bridges et al. | 585/648 |
| 2003/0070963 | A1 | 4/2003 | Zimmermann et al. | 208/106 |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2004/0039240 | A1 | 2/2004 | Powers | 585/652 |
| 2004/0054247 | A1 | 3/2004 | Powers | 585/652 |
| 2005/0010075 | A1 | 1/2005 | Powers | 585/648 |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2006259 | 10/1977 |
| GB | 2012176 | 11/1977 |
| NL | 7410163 | 4/1975 |
| SU | 1491552 | 7/1989 |
| WO | WO 01/55280 | 8/2001 |
| ZA | 907394 | 7/1991 |

OTHER PUBLICATIONS

Dennis A. Duncan and Vance A. Ham, Stone & Webster, "The Practicalities of Steam-Cracking Heavy Oil" Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16, 1992.

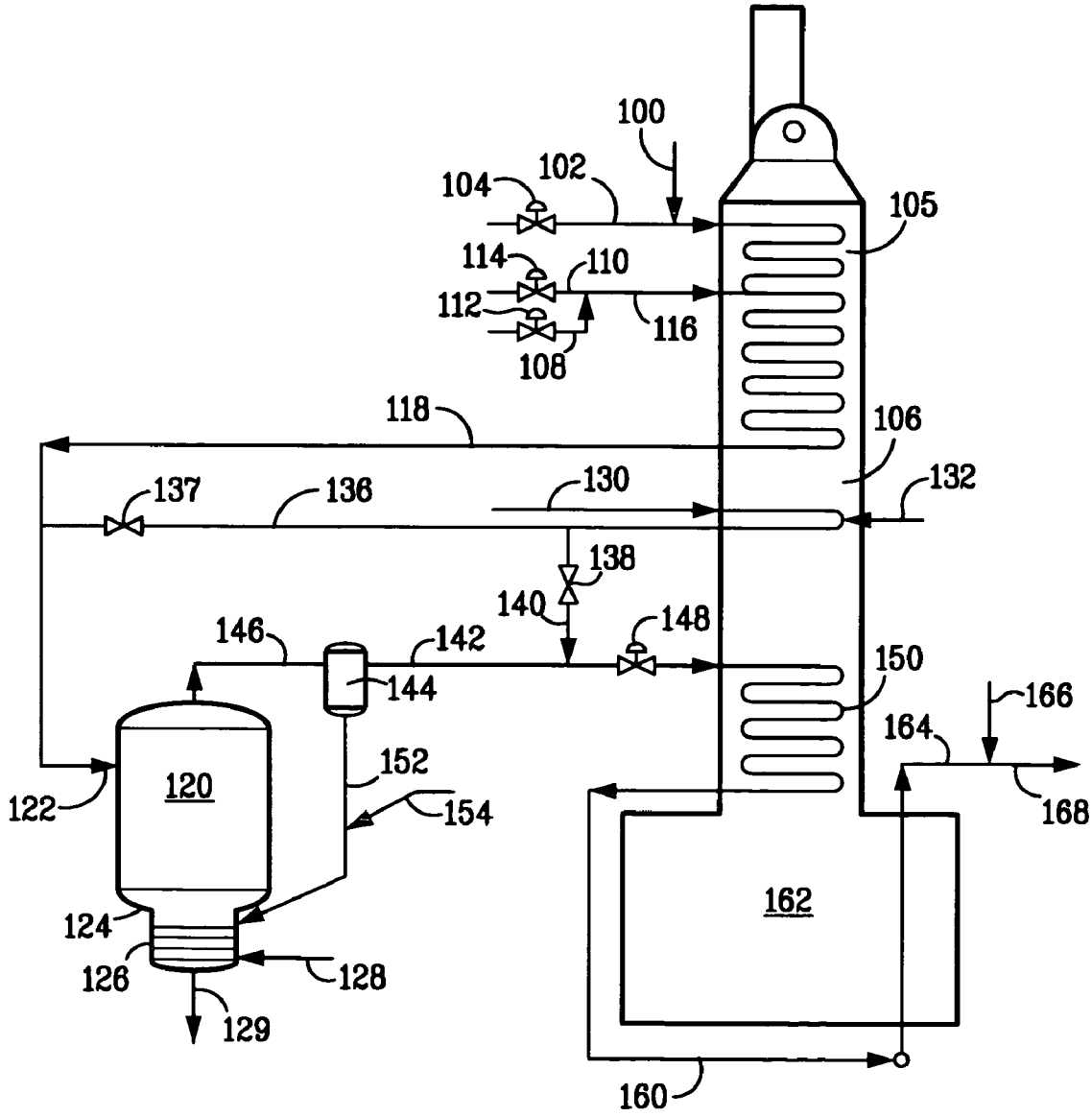
100
102
104
105
114
110
112
116
108
118
106
137
136
130
132
138
140
146
142
148
144
150
166
164
152
120
122
154
168
124
162
126
128
129
160

REDUCTION OF TOTAL SULFUR IN CRUDE AND CONDENSATE CRACKING

FIELD

The present invention relates to the cracking of hydrocarbons that contain relatively non-volatile hydrocarbons and other contaminants, including sulfur-containing compounds. More particularly, the present invention relates to the reduction of sulfur-containing compounds in the feed to a steam cracker, which permits the use of higher sulfur content feeds.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is the introduced into the radiant section where the cracking takes place. The resulting products comprising olefins leave the pyrolysis furnace for further downstream processing, including quenching.

Pyrolysis involves heating the feedstock sufficiently to cause thermal decomposition of the larger molecules. The pyrolysis process, however, produces molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

Conventional steam cracking systems have been effective for cracking high-quality feedstock which contain a large fraction of light volatile hydrocarbons, such as gas oil and naphtha. However, steam cracking economics sometimes favor cracking lower cost feedstocks containing resids such as, by way of non-limiting examples, atmospheric residue, e.g., atmospheric pipestill bottoms, and crude oil. Crude oil and atmospheric residue often contain high molecular weight, non-volatile components with boiling points in excess of 590° C. (1100° F.). The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha crackers, cooling of the effluent from the cracking furnace is normally achieved using a system of transfer line heat exchangers, a primary fractionator, and a water quench tower or indirect condenser. The steam generated in transfer line exchangers can be used to drive large steam turbines which power the major compressors used elsewhere in the ethylene production unit. To obtain high energy-efficiency and power production in the steam turbines, it is necessary to superheat the steam produced in the transfer line exchangers.

Cracking heavier feeds, such as kerosenes and gas oils, produces large amounts of tar, which leads to rapid coking in the radiant section of the furnace as well as fouling in the transfer line exchangers preferred in lighter liquid cracking service.

Additionally, during transport some naphthas are contaminated with heavy crude oil containing non-volatile components. Conventional pyrolysis furnaces do not have the flexibility to process residues, crudes, or many residue or crude contaminated gas oils or naphthas which comprise non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 and 1100° F. (230 and 590° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking. Periodic regeneration above pyrolysis temperature is effected with air and steam.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

Co-pending U.S. application Ser. No. 10/188,461 filed Jul. 3, 2002, Patent Application Publication US 2004/0004022 A1, published Jan. 8, 2004, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

Co-pending U.S. Patent Application Ser. No. 60/555,282, filed Mar. 22, 2004, (Attorney Docket 2004B001-US) describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. The amount of fluid mixed with the feedstock is varied in accordance with a selected operating parameter of the process, e.g., temperature of the mixture stream before the mixture stream is flashed, the pressure of the flash, the flow rate of the mixture stream, and/or the excess oxygen in the flue gas of the furnace.

The yield of the least desirable product of steam cracking, steam cracked tar, is generally even higher when low quality feeds, for example, feeds containing sulfur and/or nitrogen compounds are used. To address desulfurization, U.S. Pat. Nos. 6,190,533; 6,123,830; and 6,210,561, all of which are incorporated herein by reference, disclose integrated processes for converting hydrocarbon feedstocks into steam cracked products. The processes involve passing feedstock to a hydrotreating zone containing at least two hydrotreating catalysts to effect decomposition of organic sulfur and/or nitrogen containing compounds. Product from the hydrotreating zone is passed to an aromatics saturation zone and then passed to a steam cracking zone. The major disadvantages of these processes are high cost, high reactor temperatures and pressures, high residence time, emissions and a hydrogen requirement.

Low sulfur levels in heavy steam cracker feedstock requires the removal of compounds that resist conventional desulfurization, such as sterically hindered dibenzothiophenes. U.S. Pat. No. 5,910,440 discloses a process to remove organic sulfur from organic compounds and organic carbonaceous fuel substrates. The process includes oxidizing the sulfur species to the sulfone and/or the sulfoxide form with resultant desulfurized product sent to low sulfur fuel dispositions.

Accordingly, it would be desirable to provide a process for reducing the sulfur levels in sulfur-containing feeds used for steam cracking processes utilizing an integrated flash drum before the radiant section of the furnace, which does not require significant investment in pretreating and/or post-treating the sulfur species.

SUMMARY

In one aspect, the present invention relates to a process for cracking hydrocarbon feedstock containing resid and at least one sulfur-containing compound, but typically more. The process comprises: heating a combination of the feedstock and a peroxide-containing compound, mixing the heated combination of feedstock and sulfur-containing compound with a fluid stream to form a mixture, flashing the mixture to form vapor phase overhead and liquid phase bottoms and removing the bottoms, separating and cracking the vapor phase, and cooling the product effluent.

In another aspect, the present invention relates to a process for cracking hydrocarbon feedstock containing resid and comprising at least one sulfur-containing compound, wherein the process comprises: (a) heating a combination of hydrocarbon feedstock and a peroxide-containing compound under conditions sufficient to effect oxidation of said at least one sulfur-containing compound; (b) mixing the heated combination with a fluid to form a mixture stream; (c) flashing the mixture stream in a flash/separation vessel to form a vapor phase overhead and liquid phase bottoms; (d) removing the liquid phase bottoms from the flash/separation vessel; (e) cracking the vapor phase overhead to produce an effluent comprising olefins; (f) quenching the effluent; and (g) recovering cracked product from the quenched effluent.

In any embodiment described herein the heating may be carried out to a temperature of at least about 455° C., preferably from about 200 to about 455° C.

In any embodiment described herein the peroxide-containing compound may be added to the feed in amounts ranging from about 0.5 to about 1.5 molar equivalents per mole of sulfur-containing species, or from about 0.8 to about 1.2 molar equivalents per mole of sulfur-containing species. In any embodiment described herein the peroxide-containing compound may be hydrogen peroxide or an organoperoxide, or may be selected from the group consisting of alkyl peroxide, alkyl hydrogen peroxide, aryl peroxide, peroxy organic acid, and inorganic salt of peroxide. The alkyl peroxide may be t-butyl peroxide, the aryl peroxide may be benzoyl peroxide, the peroxy organic acid may be selected from the group consisting of performic acid and peracetic acid, and the inorganic salt of peroxide may be the sodium salt of hydrogen peroxide.

In any embodiment described herein, the sulfur-containing compound may be oxidized to a sulfoxide-containing compound, and the sulfoxide-containing compound may be selected from the group consisting of alkyl sulfoxide, thiophenic sulfoxide, benzosulfoxide and dibenzothiophenic sulfoxide.

In any embodiment described herein, the sulfur-containing compound may be oxidized to a sulfone-containing compound, and the sulfone-containing compound may be selected from the group consisting of alkyl sulfone, thiophenic sulfone, benzosulfone and dibenzothiophenic sulfone; and/or the sulfone-containing compound may be selected from the group consisting of diphenyl sulfone, methyl phenyl sulfone, dibenzothiophene sulfone, 4,6-diethyldibenzothiophene, diphenyl sulfoxide, and methyl phenyl sulfoxide.

In any embodiment described herein, the sulfur-containing compound may be oxidized and removed in the liquid phase of the flash/separation vessel.

In any embodiment described herein, the sulfur-containing compound may be selected from the group consisting of mercaptan, alkyl disulfide, aryl disulfide, dibenzothiphene, aryl thiophene, and thiophenic sulfur-containing compounds. The thiophenic sulfur-containing compound may be selected from the group consisting of aryl thiophenic compounds and alkyl thiophenic compounds. In a preferred embodiment the sulfur-containing compound is dibenzothiophene.

In any embodiment described herein, the unreacted peroxide-containing compound may be removed in the liquid phase of the flash/separation vessel of step (d) and recycled to step (a).

BRIEF DESCRIPTION OF THE DRAWINGS

FIG. 1 illustrates a schematic flow diagram of a process in accordance with the present invention employed with a knockout flash drum.

DETAILED DESCRIPTION

The process of the present invention relates to the reduction of total sulfur in heavy steam cracker feedstock including crudes, condensates and heavy non-virgin feeds. The sulfur is heated and combined with a peroxide-containing compound thereby causing oxidation of the sulfur. The higher boiling oxidized sulfur species may then be removed in a flash drum from the bottoms stream thereby reducing the sulfur levels in sulfur-containing feed to the radiant section of the steam cracker and obviates post-treating the sulfur species.

Sulfur-containing compounds present in hydrocarbon feedstocks utilized in the present invention typically include mercaptans, alkyl disulfides, aryl disulfides, thiophenic sulfurs, and aryl-thiophenic sulfurs. These components can be present in hydrocarbon feedstocks from about 0.1 wt % to about 5 wt %, total S content. The total weight concentration of sulfur species measure as atomic sulfur can be measured by ASTM methods D-4294, D-2622, D-1552 or D-5453. Overhead feeds from the flash/separation vessel to the pyrolysis furnace of a steam cracker should desirably contain from about 0.05 wt % to about 2 wt %, total S. The desired sulfur removal is thus carried out by adding a peroxide containing compound, such as hydrogen peroxide or organo-peroxide to the feed. Oxidation of the sulfur increases the boiling point of sulfur-containing molecules resulting in a significant portion of sulfur, otherwise destined as overhead, going to the bottoms of the flash drum integrated with the steam cracker furnace. Additionally, oxidized mercaptans, e.g., sulfoxides and/or sulfones can react by an elimination reaction to yield oxidized sulfur and olefin.

In the process of the present invention, peroxides are used to oxidize the sulfur species in a steam cracker feed to provide sulfoxides and/or sulfones of greater boiling point than their sulfur-containing precursors. The amount of oxidation achieved will depend on the type and characteristics of the feestock and the oxidation catalyst chosen. In a preferred embodiment, at least 50% of the total sulfur in the hydrocarbon feedstock is oxidized. A flash drum then separates the higher boiling sulfoxides and sulfones from the steam cracker feed. The heavier sulfur species go to flash drum bottoms into a lower value product, while the flash drum overhead is of sufficiently low sulfur content to be used as feed to the steam cracker pyrolysis furnace.

Particular examples of suitable peroxide containing compounds include hydrogen peroxide and/or organo-peroxides, such as alkyl peroxide, alkyl hydrogen peroxide, aryl peroxide, peroxy organic acid, and inorganic salt of peroxide. Suitable alkyl peroxides include t-butyl peroxide, suitable aryl peroxides include benzoyl peroxide, suitable peroxy organic acids include performic acid and peracetic acid, and suitable inorganic salts of peroxide include the sodium salt of hydrogen peroxide.

The peroxide-containing compounds are added to the feed in molar equivalents per mole of sulfur-containing species. Generally, the peroxide-containing compound is added to the feed in amounts ranging from about 0.5 to about 1.5 molar equivalents, e.g., from about 0.8 to about 1.2 molar equivalents, per mole of sulfur-containing species. The peroxide-containing compound in a heavy hydrocarbon feedstock/peroxide-containing compound feedstock generally ranges from about 0.5 to about 8 wt %, say, from about 1 to about 5 wt %, based on the combination of heavy hydrocarbon feedstock and peroxide-containing compound.

The sulfur-containing compounds in the feedstock are oxidized with, for example, hydrogen peroxide, to sulfones, sulfoxides or other oxidized sulfur species, including alkyl sulfoxide, thiophenic sulfoxide, benzothiophene sulfoxide, dibenzothiophenic sulfoxide, alkyl sulfone, thiophenic sulfone, benzothiophene sulfone, dibenzothiophenic sulfone, and more specifically, diphenyl sulfone, methyl phenyl sulfone, dibenzothiophene sulfone, 4,6-diethyldibenzothiophene, diphenyl sulfoxide, and methyl phenyl sulfoxide. In addition, mercaptan sulfoxides and sulfones may further react via elimination to yield an olefin and oxidized sulfur.

The process of the present invention creates a petroleum and water emulsion in which the oxidizer, such as hydrogen peroxide, is used to convert the sulfur in the sulfur containing compounds to a sulfoxide, sulfone, or other oxidized sulfur species. The oxidized sulfur species is then separated from the hydrocarbons for post-processing.

In an embodiment of the present invention, the mixture stream is heated to vaporize any water present and at least partially vaporize hydrocarbons present in the mixture stream. Additional steam can be added to the mixture stream after the mixture stream is heated.

In one embodiment, water is added to the heated hydrocarbon feedstock prior to the flashing.

In an embodiment, the mixture stream is further heated, e.g., by convection heating, prior to the flashing.

Conditions are preferably maintained within the vapor/liquid separation apparatus so as to maintain the liquid bottoms at a suitable temperature, for example, of at least about 427° C. (800° F.), e.g., at a temperature ranging from about 427 to about 468° C. (800 to 875° F.).

In applying this invention, the hydrocarbon feedstock comprising at least one sulfur-containing compound and the peroxide-containing compound may be heated by indirect contact with flue gas in a first convection section tube bank of the pyrolysis furnace before mixing with the fluid. Preferably, the temperature of the hydrocarbon feedstock ranges from about 150 to about 260° C. (300 to 500° F.) before mixing with the fluid.

The mixture stream may then be further heated by indirect contact with flue gas in a first convection section of the pyrolysis furnace, before being flashed. Preferably, the first convection section is arranged to add the fluid, and optionally primary dilution steam, between rows of that section such that the hydrocarbon feedstock can be heated before mixing with the fluid and dilution steam, and then the mixture stream, can be further heated before being flashed.

The temperature of the flue gas entering the first convection section tube bank is preferably less than about 815° C. (1500° F.), for example, less than about 700° C. (1300° F.), such as less than about 620° C. (1150° F.), and preferably less than about 540° C. (1000° F.).

Dilution steam may be added at any point in the process, for example, it may be added to the hydrocarbon feedstock containing resid before or after heating, to the mixture stream, and/or to the vapor phase. Any dilution steam stream may comprise sour steam. Any dilution steam stream may be heated or superheated in a convection section tube bank located anywhere within the convection section of the furnace, preferably in the first or second tube bank.

The mixture stream may be at about 315 to about 540° C. (600° F. to 1000° F.) before the flash in step (c), and the flash pressure may be about 275 to about 1375 kPa (40 to 200 psia). Following the flash, from about 50 to about 98% of the mixture stream may be in the vapor phase. An additional separator such as a centrifugal separator may be used to remove trace amounts of liquid from the vapor phase. The vapor phase may be heated to above the flash temperature before entering the radiant section of the furnace, for example, from about 425 to about 705° C. (800 to 1300° F.). This heating may occur in a convection section tube bank, preferably the tube bank nearest the radiant section of the furnace.

Unless otherwise stated, all percentages, parts, ratios, etc. are by weight. Ordinarily, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, non-volatile components are the fraction of the hydrocarbon feed with a nominal boiling point above 590° C. (1100° F.) as measured by ASTM D-6352-98 or D-2887. This invention works very well with non-volatiles having a nominal boiling point above 760° C. (1400° F.). The boiling point distribution of the hydrocarbon feed is measured by Gas Chromatograph Distillation (GCD) by ASTM D-6352-98 or D-2887. Non-volatiles include coke precursors, which are large, condensable molecules which condense in the vapor, and then form coke under the operating conditions encountered in the present process of the invention.

The hydrocarbon feedstock can comprise a large portion, such as from about 5 to about 50%, of non-volatile components, i.e., resid. Such feedstock could comprise, by way of non-limiting examples, one or more of steam cracked gas oils and residues, gas oils, heating oil, jet fuel, diesel, kerosene, gasoline, catalytically cracked naphtha, hydrocrackate, reformate, raffinate reformate, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, C4's/residue admixture, naphtha/residue admixture, hydrocarbon gases/residue admixture, hydrogen/residue admixtures, gas oil/residue admixture, and crude oil.

The hydrocarbon feedstock further contains at least one sulfur-containing compound including mercaptan, alkyl disulfide, aryl disulfide, dibenzothiphene, aryl thiophene, and thiophenic sulfur-containing compounds.

The hydrocarbon feedstock can have a nominal end boiling point of at least about 315° C. (600° F.), generally greater than about 510° C. (950° F.), typically greater than about 590° C. (1100° F.), for example, greater than about 760° C. (1400° F.). The economically preferred feedstocks are generally low sulfur waxy residues, atmospheric residues, naphthas contaminated with crude, various residue admixtures and crude oil.

In an embodiment of the present invention depicted in FIG. 1, a peroxide-containing compound, e.g., hydrogen peroxide, added via line 100 is combined with hydrocarbon feed stream (containing at least one sulfur-containing compound) 102, e.g., atmospheric resid. Feed input is controlled by feed inlet valve 104 and the resulting feed and peroxide-containing compound mixture is heated in an upper convection section 105 of a furnace 106. Preferably the peroxide is added in amounts ranging from a 1:10 to a 10:1, say, 1:1 molar basis with total sulfur in the hydrocarbon feedstream. Then steam stream 108 and water stream 110, controlled by valves 112 and 114, respectively, are introduced through line 116 to the hydrocarbon and the peroxide-containing compound in the upper convection section. The resulting mixture is further heated in the convection section where all of the water vaporizes and a fraction of the hydrocarbon vaporizes. Preferably, this heating is carried out to a temperature up to about 455° C., e.g., a temperature ranging from about 200 to about 455° C.

Exiting upper convection section 105, the mixture stream 118, generally at a temperature of about 455° C. (850° F.) enters a vapor/liquid separation apparatus or flash drum 120 by a tangential inlet 122 where a vapor/liquid separation occurs. The vapor is at its dew point. The liquid resid, containing oxidized sulfur compounds with a total of about 10 wt % total S content, falls to the bottom section 124 of the flash drum and into a cylindrical boot 126, where quench oil introduced via line 128 prevents excessive coking of the liquid bottoms. The liquid bottoms containing the oxidized sulfur species are withdrawn through line 129.

Additional dilution steam stream 130 is superheated in the convection section 106, desuperheated by water 132 and the discharged steam is passed via line 136 and introduced via valve 137 to line 118 to vaporize additional hydrocarbon before the mixture in 118 enters flash drum 120 via tangential inlet 122.

The discharged steam can alternately or additionally be introduced via control valve 138 and line 140 to the steam/hydrocarbon vapor 142 taken as an outlet stream from centrifugal separator 144, which receives overhead containing liquid (which overhead is substantially free of sulfur and sulfur compounds) from the flash drum 120 via line 146. The mixture of discharged steam and the steam/hydrocarbon vapor from the centrifugal separator is directed by control valve 148 to lower convection section 150. Centrifugal separator bottoms containing liquid taken from flash drum overhead are introduced via line 152 to the boot 126. Fluxant which reduces the viscosity of the partially visbroken liquid in the boot 126 can be added via line 154.

The steam/hydrocarbon vapor derived from the flash drum overhead passes from the lower convection section 150 via crossover piping 160 and through the radiant section 162 of the furnace where it undergoes cracking. The cracked effluent exits the radiant section through line 164 and is quenched with quench oil 166 before further treatment by the recovery train 168.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for cracking hydrocarbon feedstock containing resid and comprising at least one sulfur-containing compound, said process comprising:

(a) heating a combination of said hydrocarbon feedstock and a peroxide-containing compound;

(b) mixing the heated combination of hydrocarbon feedstock and peroxide-containing compound with a fluid to form a mixture stream;

(c) flashing the mixture stream in a flash/separation vessel to form a vapor phase overhead and a liquid phase;

(d) removing the liquid phase from said flash/separation vessel;

(e) cracking the vapor phase overhead to produce an effluent comprising olefins;

(f) quenching the effluent; and (g) recovering cracked product from the quenched effluent.

2. The process of claim 1 wherein said heating is carried out to a temperature of at least about 455° C.

3. The process of claim 1 wherein said heating is carried out to a temperature ranging from about 200 to about 455° C.

4. The process of claim 1 wherein the peroxide-containing compound is added to the feed in amounts ranging from about 0.5 to about 1.5 molar equivalents per mole of sulfur-containing species.

5. The process of claim 1 wherein the peroxide-containing compound is added to the feed in amounts ranging from about 0.8 to about 1.2 molar equivalents per mole of sulfur-containing species.

6. The process of claim 1 wherein the peroxide-containing compound is hydrogen peroxide.

7. The process of claim 1 wherein the peroxide-containing compound is an organo-peroxide.

8. The process of claim 7 wherein said organo-peroxide is selected from the group consisting of alkyl peroxide, alkyl hydrogen peroxide, aryl peroxide, peroxy organic acid, and inorganic salt of peroxide.

9. The process of claim 8 wherein said alkyl peroxide is t-butyl peroxide, said aryl peroxide is benzoyl peroxide, said peroxy organic acid is selected from the group consisting of performic acid and peracetic acid, and said inorganic salt of peroxide is the sodium salt of hydrogen peroxide.

10. The process of claim 1 wherein said sulfur-containing compound is oxidized to a sulfoxide-containing compound.

11. The process of claim 10 wherein said sulfoxide-containing compound is selected from the group consisting of alkyl sulfoxide, thiophenic sulfoxide, benzosulfoxide and dibenzothiophenic sulfoxide.

12. The process of claim 1 wherein said sulfur-containing compound is oxidized to a sulfone-containing compound.

13. The process of claim 12 wherein said sulfone-containing compound is selected from the group consisting of alkyl sulfone, thiophenic sulfone, benzosulfone and dibenzothiophenic sulfone.

14. The process of claim 13 wherein said sulfone-containing compound is selected from the group consisting of diphenyl sulfone, methyl phenyl sulfone, dibenzothiophene sulfone, 4,6-diethyldibenzothiophene, diphenyl sulfoxide, and methyl phenyl sulfoxide.

15. The process of claim 1 wherein said sulfur-containing compound is oxidized and removed in the liquid phase of the flash/separation vessel.

16. The process of claim 1 wherein unreacted peroxide-containing compound is removed in the liquid phase of the flash/separation vessel of step (d) and recycled to step (a).

17. The process of claim 1 wherein the sulfur-containing compound is selected from the group consisting of mercaptan, alkyl disulfide, aryl disulfide, dibenzothiphene, aryl thiophene, and thiophenic sulfur-containing compounds.

18. The process of claim 17 wherein the thiophenic sulfur-containing compound is selected from the group consisting of aryl thiophenic compounds and alkyl thiophenic compounds.

19. The process of claim 17 wherein the sulfur-containing compound is dibenzothiophene.

* * * * *